US012584310B2

(12) United States Patent
Hu et al.

(10) Patent No.: US 12,584,310 B2
(45) Date of Patent: Mar. 24, 2026

(54) ROOF CURTAIN WALL STRUCTURE AND ITS CONSTRUCTION METHOD

(71) Applicants: Beijing Institute of Architectural Design, Beijing (CN); Yue Hu, Beijing (CN)

(72) Inventors: Yue Hu, Beijing (CN); Yapeng You, Beijing (CN)

(73) Assignees: Beijing Institute of Architectural Design, Beijing (CN); Yue Hu, Beijing (CN)

( * ) Notice: Subject to any disclaimer, the term of this patent is extended or adjusted under 35 U.S.C. 154(b) by 0 days.

(21) Appl. No.: 19/239,963

(22) Filed: Jun. 17, 2025

(65) Prior Publication Data

US 2026/0002359 A1 Jan. 1, 2026

(30) Foreign Application Priority Data

Jun. 28, 2024 (CN) ..... 202410857575.9

(51) Int. Cl.
*E04B 7/20* (2006.01)

(52) U.S. Cl.
CPC ..... *E04B 7/20* (2013.01)

(58) Field of Classification Search
CPC ..... E04B 7/08; E04B 7/20; E04B 7/10; E04B 7/102; E04B 7/105; E04D 3/24
See application file for complete search history.

(56) References Cited

U.S. PATENT DOCUMENTS 3,461,626 A * 8/1969 Aitken ..... E04B 7/16 52/71
3,925,941 A * 12/1975 Pearce ..... A63B 9/00 52/80.2
3,970,301 A * 7/1976 Lehmann ..... E04H 15/18 428/542.6
4,719,726 A * 1/1988 Bergman ..... E04B 1/3211 52/81.4
6,418,673 B1 * 7/2002 Flowerday ..... E04B 1/3211 52/81.1
8,869,464 B2 * 10/2014 Newland ..... G06F 17/10 52/80.1

FOREIGN PATENT DOCUMENTS

CN 107035031 B * 1/2018 ..... F21V 23/003
CN 217379426 U 9/2022
CN 220666627 U 3/2024
FR 2376268 A1 * 7/1978
GB 2495734 A * 4/2013 ..... E04B 1/3412

* cited by examiner

*Primary Examiner* — Christine T Cajilig

(57) ABSTRACT

A roof curtain wall structure and its construction method are provided, which relates to the field of construction technologies. The roof curtain wall structure includes multiple laying units, and the multiple laying units are arranged in a matrix array. Each of the multiple laying units includes multiple laying components, and the laying components are sequentially connected along a circumferential direction of the laying unit to form a positioning point on a center of the laying unit. The roof curtain wall structure is used to address a technical issue of axis deviation and axial grid failure in the related art due to mutual dependency of axes of the laying units.

6 Claims, 3 Drawing Sheets

ROOF CURTAIN WALL STRUCTURE AND ITS CONSTRUCTION METHOD

CROSS-REFERENCE TO RELATED APPLICATION

This application claims priority to Chinese Patent Application No. 202410857575.9, filed on Jun. 28, 2024, which is herein incorporated by reference in its entirety.

TECHNICAL FIELD

The disclosure relates to the field of construction technologies, and more particularly to a roof curtain wall structure and its construction method.

BACKGROUND

Currently, when dealing with a large-area roof curtain wall, an integrated hoisting prefabricated construction technology is usually adopted, that is, a roof is regarded as a whole for structural design and assembly. This method is simple and efficient in structure.

In the related art, during such assembly, positioning is generally based on edges of laying units, which is similar to playing a jigsaw puzzle, the laying units can be analogized to puzzle pieces, and the roof curtain wall can be analogized to the puzzle, the positioning is performed through the edges of the puzzle pieces to assemble multiple puzzle pieces into a complete puzzle.

However, when assembling the roof curtain wall, the positioning relies solely on the edges of the laying units as axes, when one laying unit deviates in position, i.e., when the position of one laying unit is inaccurate, thus the positions of other laying units need to be adjusted, leading to axis deviation and axial grid failure, thereby introducing a series of complex geometric and construction challenges.

SUMMARY

The disclosure provides a roof curtain wall structure and its construction method to address a technical issue of axis deviation and axial grid failure in the related art due to mutual dependency of axes of laying units.

The disclosure provides a roof curtain wall structure, including: multiple laying units, and the multiple laying units are arranged in a matrix array. Each of the multiple laying units includes multiple laying components, and the laying components are sequentially connected along a circumferential direction of the laying unit to form a positioning point on a center of the laying unit.

According to an embodiment of the disclosure, along a first direction, any adjacent two of the multiple laying units are connected through two of the multiple laying components to define three hollow areas collinear along the first direction on an area where the adjacent two of the multiple laying units are located. The positioning point is located on a center of each hollow area. The first direction is a length direction or a width direction of the matrix array.

According to an embodiment of the disclosure, along a second direction, two sides of a connection of centers of the hollow areas of any adjacent two of the multiple laying units have two hollow areas collinear along the first direction. The second direction is a length direction or a width direction of the matrix array, and the second direction is different from the first direction.

According to an embodiment of the disclosure, the multiple laying units are sequentially arranged, and the multiple laying units are a first laying unit, a second laying unit, a third laying unit and a fourth laying unit. Along the first direction, the first laying unit is connected to the second laying unit through a first laying component and a second laying component to define a hollow area at a connection between the first laying unit and the second laying unit, and the third laying unit is connected to the fourth laying unit through a third laying component and a fourth laying component to define a hollow area at a connection between the third laying unit and the fourth laying unit.

According to an embodiment of the disclosure, along the second direction, the first laying unit is connected to the fourth laying unit, the second laying unit is connected to the third laying unit, and the second laying component is connected to the third laying component.

According to an embodiment of the disclosure, along the first direction, the first laying component is disposed opposite to the second laying component, and the third laying component is disposed opposite to the fourth laying component.

According to an embodiment of the disclosure, each of the multiple laying units is enclosed by the multiple laying components to define an accommodation cavity, and the accommodation cavity is funnel-shaped with an inner diameter gradually decreasing from top to bottom for collecting and discharging rainwater.

According to an embodiment of the disclosure, each of the multiple laying units further includes a storm sewer and multiple drainage strips. The storm sewer is located on the center of each of the hollow areas. In the laying unit, each of the multiple drainage strips corresponds to one of the multiple laying components, the multiple drainage strips are disposed along a radial direction of the laying unit, and each of the multiple drainage strips defines a drainage groove running through two ends thereof. The storm sewer is connected to an end of each the multiple laying components through the multiple drainage strips.

According to an embodiment of the disclosure, each of the hollow areas is regular hexagonal, and each corner of each of the hollow area in regular hexagonal is enclosed by adjacent two of the multiple laying components.

The disclosure further provides a construction method of a roof curtain wall structure, including: arranging multiple positioning positions on a building base; installing an overall structural keel according to the multiple positioning positions; and installing the multiple laying units on the overall structural keel. Specifically, the positioning point of each of the multiple laying units corresponds to one of the multiple positioning positions.

The roof curtain wall structure and its construction method of the disclosure have the following features and advantages.

By setting the positioning point at the center of each laying unit and sequentially connecting the multiple laying components along the circumferential direction to form this positioning point, this design innovatively changes a traditional method of relying on edges of the laying units for positioning. This structural design not only ensures that each laying unit can be independently and precisely positioned, but also significantly enhances the axis stability and assembly accuracy of the entire roof curtain wall structure.

Specifically, when a laying unit undergoes a slight displacement, each laying unit self-adjusts through the central positioning point and no longer solely relies on the edge alignment of adjacent laying units, thus it does not trigger a chain reaction causing axis deviation, ensuring overall coordination of the axial grid and construction efficiency. This solution effectively addresses the issue of cumulative positioning errors caused by the mutual dependency of the axes of the laying unit in the related art, which significantly reduces a risk of geometric misalignment and construction difficulty in large-area roof curtain wall assembly, improves assembly flexibility and construction quality, thereby ensuring precise implementation and long-term stability of the project.

BRIEF DESCRIPTION OF DRAWINGS

In order to more clearly describe technical solutions in the disclosure or the related art, drawings required to be used in descriptions of embodiments or the related art will be briefly introduced below. Apparently, the drawings in the following description are some of the embodiments of the disclosure. For those skilled in the art, other drawings can be obtained based on these drawings without creative efforts.

DESCRIPTION OF REFERENCE SIGNS

Figure 1:
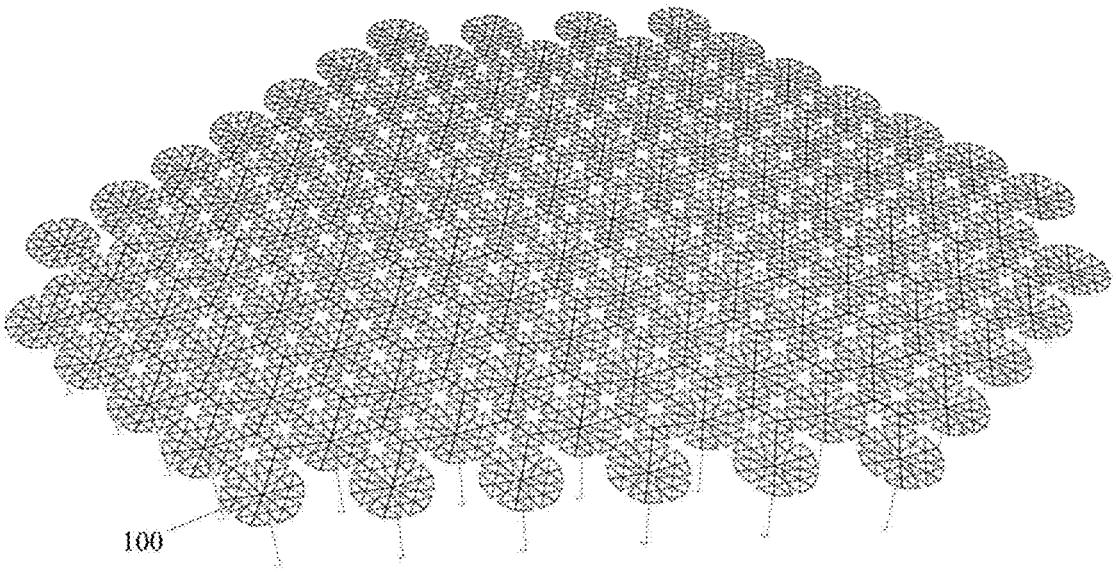
FIG. 1 illustrates a schematic three-dimensional diagram of a roof curtain wall structure according to an embodiment of the disclosure.
Figure 2:
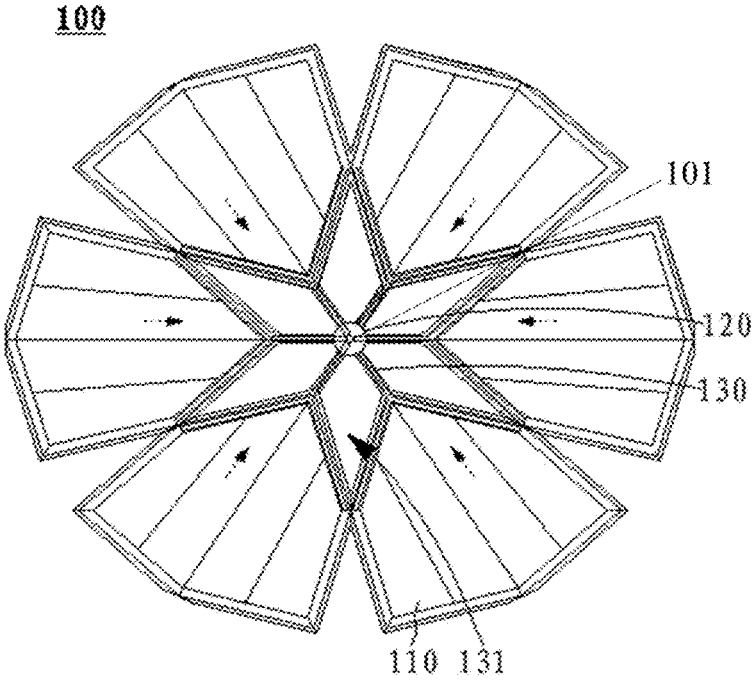
FIG. 2 illustrates a schematic diagram from a top perspective of a laying unit of the roof curtain wall structure according to an embodiment of the disclosure.
Figure 3:
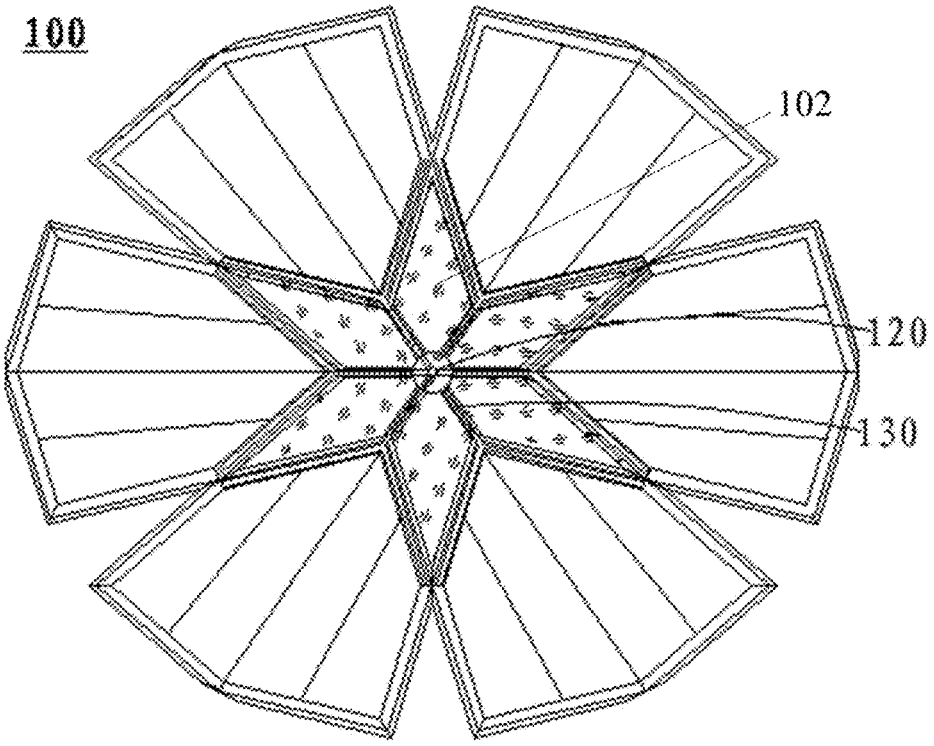
FIG. 3 illustrates a schematic diagram from a top perspective of a laying unit of the roof curtain wall structure according to another embodiment of the disclosure.
Figure 4:
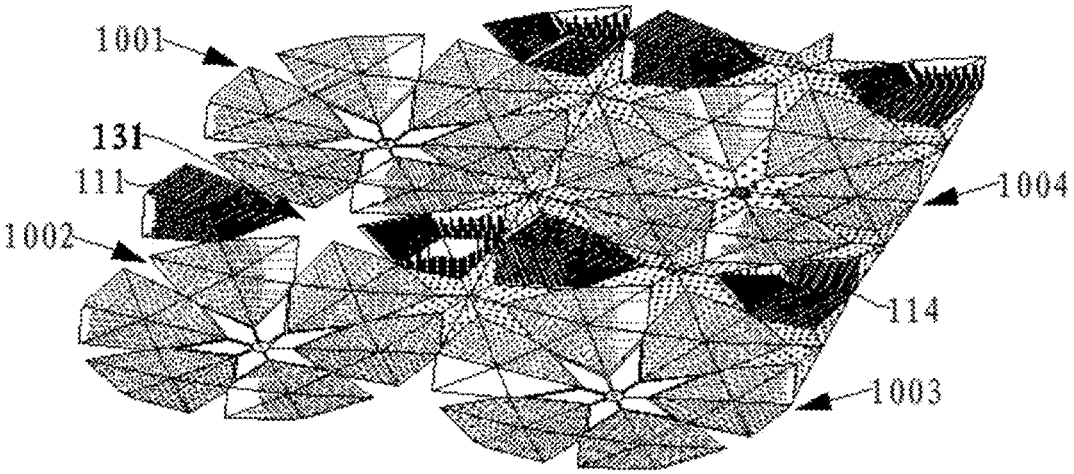
FIG. 4 illustrates a schematic three-dimensional diagram of a roof curtain wall structure according to another embodiment of the disclosure.

100—laying unit; 101—positioning point; 102—accommodation cavity; 110—laying component; 111—first laying component; 112—second laying component; 113—third laying component; 114—fourth laying component; 120—storm sewer; 130—drainage strip; 131—hollow area; 1001—first laying unit; 1002—second laying unit; 1003—third laying unit; 1004—fourth laying unit; F—first direction; S—second direction.

DETAILED DESCRIPTION OF EMBODIMENTS

In order to clarify purposes, technical solutions, and advantages of embodiments of the disclosure, the technical solutions in the embodiments of the disclosure will be described clearly and completely below in conjunction with the drawings. Apparently, the described embodiments are merely some of embodiments of the disclosure, rather than all of embodiments of the disclosure. Based on the embodiments described in the disclosure, all other embodiments obtained by those skilled in the art without creative work are within a scope of protection of the disclosure.

In the description of the embodiment, it should be understood that orientation or positional relationship indicated by terms "center", "longitudinal", "transverse", "length", "width", "thickness", "upper", "lower", "front", "rear", "left", "right", "vertical", "horizontal", "top", "bottom", "inner", "outer", "clockwise", "counterclockwise", "axial", "radial", and "circumferential" is based on orientation or positional relationship shown in the drawings, and is only for convenience of describing this embodiment and simplifying the description, rather than indicating or implying that the referred device or element must have a specific orientation or be constructed and operated in a specific orientation, and thus should not be construed as limiting this embodiment.

In addition, terms "first" and "second" are used for descriptive purposes only and cannot be understood as indicating or implying relative importance or implicitly indicating a quantity of the indicated technical features. Thus, features defined with "first" and "second" may explicitly or implicitly include at least one of the features. In the description of the embodiment, unless otherwise specifically defined, "a plurality of" means at least two, such as two or three.

In the embodiment, unless otherwise specifically specified and defined, terms "dispose", "install", "connected", "connection", and "fixed" should be understood broadly. For example, it may be a fixed connection, a detachable connection, or an integral connection; it may be a mechanical connection or an electrical connection; it may be a direct connection or an indirect connection through an intermediate medium, or it may be the internal communication between two components or the interaction relationship between two components, unless otherwise explicitly defined. For those skilled in the art, the specific meanings of the above terms in this embodiment can be understood according to specific circumstances.

In the embodiments of the disclosure, unless otherwise specifically specified and defined, a first feature being "on" or "under" a second feature may mean that the first and second features are in direct contact, or that the first and second features are in indirect contact through an intermediate medium. Moreover, the first feature being "above", "over", or "on top of" the second feature may mean that the first feature is directly above or obliquely above the second feature, or merely that the first feature is at a higher horizontal level than the second feature. The first feature being "below," "under," or "underneath" the second feature may mean that the first feature is directly below or obliquely below the second feature, or merely that the first feature is at a lower horizontal level than the second feature.

FIGS. 1-5 illustrate a roof curtain wall structure and its construction method provided in the disclosure. It can be seen from the drawings, the disclosure provides a roof curtain wall structure, including: multiple laying units 100, and the multiple laying units 100 are arranged in a matrix array. Each laying unit 100 includes multiple laying components 110, and the multiple laying components 110 are sequentially connected along a circumferential direction of the laying unit 100 to form a positioning point 101 on a center of the laying unit 100.

By setting the positioning point 101 at the center of each laying unit 100 and sequentially connecting the multiple laying components 110 along the circumferential direction to form this positioning point 101, this design innovatively changes a traditional method of relying on edges of the laying units 100 for positioning. This structural design not only ensures that each laying unit 100 can be independently and precisely positioned, but also significantly enhances axis stability and assembly accuracy of the entire roof curtain wall structure. Specifically, when a laying unit 100 undergoes a slight displacement, each laying unit 100 self-adjusts through the central positioning point 101 and no longer solely relies on the edge alignment of adjacent laying units, thus it does not trigger a chain reaction causing axis deviation, ensuring overall coordination of the axial grid and construction efficiency. This solution effectively addresses an issue of cumulative positioning errors caused by mutual dependency of the axes of the laying unit 100 in the related art, which significantly reduces a risk of geometric misalignment and construction difficulty in large-area roof curtain wall assembly, improves assembly flexibility and construction quality, thereby ensuring precise implementation and long-term stability of the project.

In the embodiment, the laying component 110 can have a shield shaped plate-like structure, and a cross-section of the laying component 110 can be an obtuse "V" shape. Each laying unit 100 includes six laying components 110.

According to an embodiment of the disclosure, along a first direction F, any adjacent two laying units 100 are connected through two laying components 110 to define three hollow areas 131 collinear along the first direction F on an area where the adjacent two laying units 110 are located. The positioning point 101 is located on a center of each hollow area 131. The first direction F is a length direction or a width direction of the matrix array.

In practice, any two adjacent laying units 100 not only establish a stable connection relationship through two directly connected laying components 110, but also cleverly form three colinear hollow areas 131 arranged along the first direction F between the two laying units 100. Such a design is not only conducive to reducing a dead weight of the structure, enhancing lighting and ventilation performance, but also adds a unique visual transparent beauty to the curtain wall. More importantly, the positioning point 101 is accurately defined at the center of each hollow area 131. This strategy further enhances the positioning accuracy of each laying unit 100. Regardless of whether the first direction F represents the length or width of the matrix array, this layout can ensure that within the entire array range, each unit closely follows a predetermined axis layout, avoiding a global misalignment problem caused by a deviation of a single unit. Therefore, this design not only structurally guarantees the stability and durability of the roof curtain wall structure, but also achieves optimization in terms of vision and function, and improves a comprehensive performance and aesthetics of the building. It should be noted that, through the aforementioned structural setting, not only is the number of the hollow areas 131 simply increased, but more importantly, more positioning points can be added, that is, there are three positioning points 101 between two laying units 100.

Figure 5:
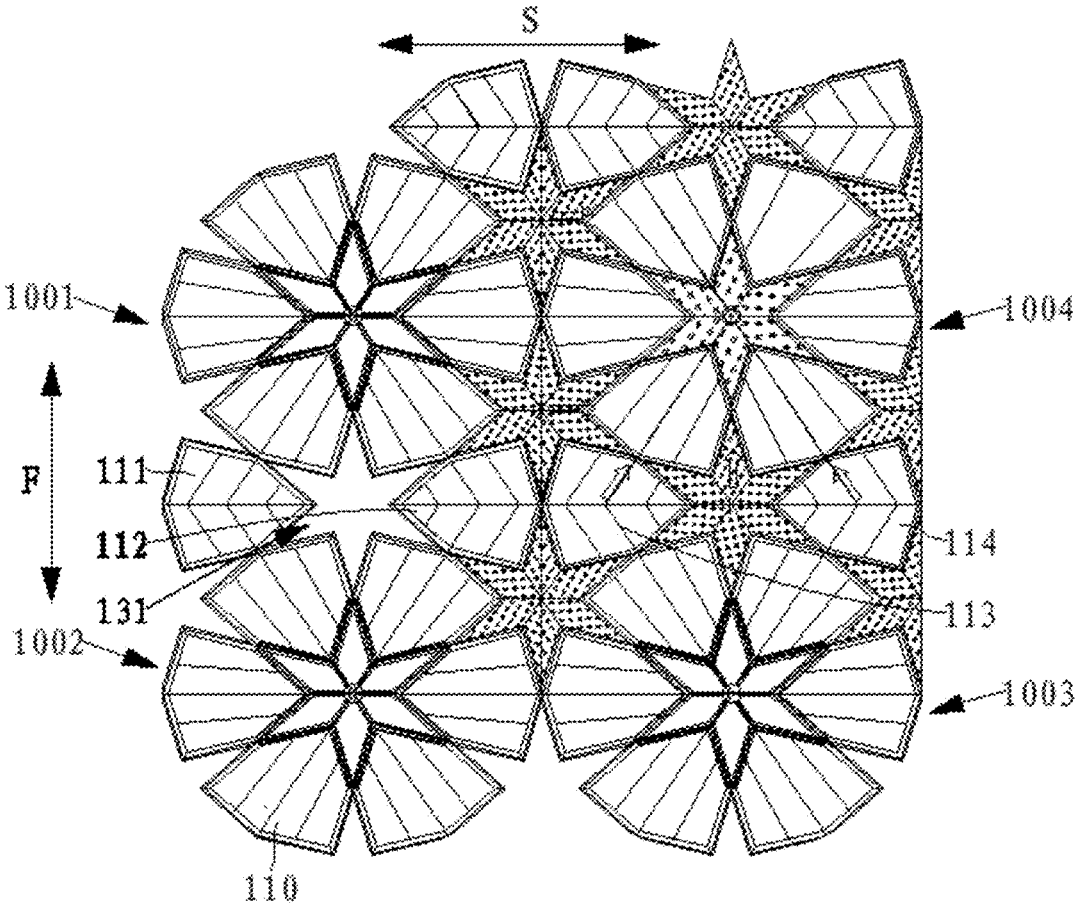
FIG. 5 illustrates a schematic diagram from a top perspective of the roof curtain wall structure in FIG. 4.

In the embodiment, the first direction F is a vertical direction in FIG. 5. The laying unit 100 has the hollow area 131.

According to an embodiment of the disclosure, each hollow area 131 is regular hexagonal, and each corner of each hollow area in regular hexagonal is enclosed by adjacent two laying components 110.

In practice, each regular hexagonal hollow area 131 not only visually presents a high degree of symmetrical beauty and geometric order, but also cleverly utilizes stability characteristics of the hexagonal structure, so that six corners of each hollow area 131 are accurately enclosed by adjacent laying components 110, which not only strengthens the connection between the laying units 100, but also ensures the overall stability of the structure. The design of the regular hexagonal hollow area 131 optimizes the use of materials. Compared with square or other shapes, the hexagonal arrangement can provide more connection points and stronger structural support in the same area, while reducing material waste. In addition, such a layout promotes natural circulation of air and light, brings better natural lighting and ventilation effects to an interior of the building, and improves ecological environment quality of the building.

According to an embodiment of the disclosure, at least one hollow area 131 is covered with a skylight.

In practice, by providing a skylight in at least one regular hexagonal hollow area 131, not only a space reserved by the original structure is cleverly utilized, but also natural light is introduced into the interior of the building, thereby enhancing brightness and openness of the space, reducing a need for artificial lighting, and facilitating energy conservation and emission reduction.

In the embodiment, the skylight is a glass skylight, and a shape of the skylight can be matched with the shape of the hollow area 131.

According to an embodiment of the disclosure, along a second direction S, two sides of a connection of centers of the hollow areas 131 of any adjacent two laying units 100 have two hollow areas 131 collinear along the first direction F. The second direction S is a length direction or a width direction of the matrix array, and the second direction S is different from the first direction F.

In practice, the second direction S and the first direction F serve as two orthogonal dimensions of the matrix array. The different settings of the second direction S and the first direction F ensure that each laying unit 100 on a two-dimensional plane can form a stable connection grid with adjacent units through four collinear hollow areas 131. This grid structure not only ensures overall stability, but also facilitates installation and maintenance of the curtain wall.

In the embodiment, the second direction S may be a horizontal direction in the drawings.

According to an embodiment of the disclosure, the multiple laying units 100 are sequentially arranged, and the multiple laying units 100 are a first laying unit 1001, a second laying unit 1002, a third laying unit 1003 and a fourth laying unit 1004. Along the first direction F, the first laying unit 1001 is connected to the second laying unit 1002 through a first laying component 111 and a second laying component 112 to define a hollow area 131 at a connection between the first laying unit 1001 and the second laying unit 1002, and the third laying unit 1003 is connected to the fourth laying unit 1004 through a third laying component 113 and a fourth laying component 114 to define a hollow area 131 at a connection between the third laying unit 1003 and the fourth laying unit 1004.

In practice, on the first direction F, the connection between the first laying unit 1001 and the second laying unit 1002 is achieved through the first laying component 111 and the second laying component 112. This connection process not only completes physical stable splicing, but also defines a first hollow area 131 between the two laying units. This design not only helps to reduce a weight of the structure, but also introduces a transparent effect of light and vision. Similarly, the third laying unit 1003 and the fourth laying unit 1004 are connected through the third laying component 113 and the fourth laying component 114, and a second hollow area 131 is also generated at the corresponding position, which not only ensures consistency and continuity of the structure, but also adds a dynamic visual level to the overall curtain wall.

In the embodiment, the first laying unit 1001, the second laying unit 1002, the third laying unit 1003 and the fourth laying unit 1004 may be sequentially arranged in that order along an anticlockwise direction.

According to an embodiment of the disclosure, along the second direction S, the first laying unit 1001 is connected to the fourth laying unit 1004, the second laying unit 1002 is connected to the third laying unit 1003, and the second laying component 112 is connected to the third laying component 113.

In practice, this design makes the first laying unit 1001 directly adjacent to the fourth laying unit 1004, and the second laying unit 1002 adjacent to the third laying unit 1003. Such a layout forms a closed ring or grid structure in the second dimension, which significantly improves lateral stability of the entire curtain wall system. More importantly, the second laying component 112 and the third laying component 113 are directly connected between two different laying units 100. This design not only optimizes structural force distribution, but also may create additional decorative or functional elements in the second direction S, for example, it may form a continuous sunshade system or a specially designed drainage channel, so as to ensure the beauty of the curtain wall while taking into account its practical performance, such as improving an energy efficiency of the building and enhancing a waterproof effect. In summary, this clever connection strategy in both directions not only strengthens the overall structural performance of the roof curtain wall structure, but also gives it multi-dimensional spatial expression and practical value, reflecting a high degree of unity of form and function in modern architectural design.

According to an embodiment of the disclosure, along the first direction F, the first laying component 111 is disposed opposite to the second laying component 112, and the third laying component 113 is disposed opposite to the fourth laying component 114.

In practice, the first laying component 111 and the second laying component 112 are disposed opposite to each other along the first direction F, ensuring a symmetrical connection of adjacent laying units 100 in this direction, which not only enhances balance of the structure, but also facilitates accurate alignment during construction and reduces installation errors. Similarly, the third laying component 113 and the fourth laying component 114 are also disposed opposite to each other, which continues this symmetrical aesthetics, so that the entire roof curtain wall structure maintains a consistent visual rhythm and structural rigor during an extension process. This symmetrical design not only improves the aesthetics of the curtain wall, but also optimizes stress distribution from a mechanical point of view, so that the structure is more stable and reliable when subjected to external loads such as wind pressure and deadweight. Symmetrically disposed components can also simplify the maintenance process to a certain extent, once a part of the structure needs to be repaired or replaced, its operating mode and required accessories can be applied to the corresponding other part in a mirror image, thereby improving maintenance efficiency. In summary, the first laying component 111 and the second laying component 112, and the third laying component 113 and the fourth laying component 114 disposed opposite to each other along the first direction F not only give the roof curtain wall structure an aesthetically harmonious unity, but also show significant technical advantages in terms of structural performance and later maintenance.

According to an embodiment of the disclosure, each laying unit is 100 enclosed by the multiple laying components 110 to define an accommodation cavity 102, and the accommodation cavity 102 is funnel-shaped with an inner diameter gradually decreasing from top to bottom for collecting and discharging rainwater, that is, each laying component 110 is inclined toward the center.

In practice, through the careful enclosure of the laying components 110, an interior of each laying unit 100 defines a special accommodation cavity, the cavity is funnel-shaped with the inner diameter gradually decreasing from top to bottom. This unique design not only makes full use of the space, but more importantly, it effectively integrates a rainwater diversion function. The funnel-shaped accommodation cavity 102 can efficiently collect rainwater flowing in from a top of the structure. As the diameter of the cavity decreases downward, the water flow is concentrated and accelerated to a preset drainage system, thereby avoiding accumulation of the rainwater inside the curtain wall structure, reducing a risk of leakage, and protecting the building structure from water erosion.

According to an embodiment of the disclosure, each laying unit 100 further includes a storm sewer 120 and multiple drainage strips 130. The storm sewer 120 is located on the center of each hollow area 131. In the laying unit 100, each drainage strip 130 corresponds to one of the multiple laying components 110, the multiple drainage strips 130 are disposed along a radial direction of the laying unit 100, and each drainage strip 130 defines a drainage groove running through two ends thereof. The storm sewer 120 is connected to an end of each laying component 110 through the multiple drainage strips 130.

In practice, through the innovative design of introducing the storm sewer 120 and the drainage strips 130, a drainage efficiency and detail processing are further optimized, which ensures a reliable performance of the curtain wall structure under extreme weather conditions. Specifically, the storm sewer 120 integrated inside each laying unit 100 is cleverly placed at the center of the hollow area 131, which can efficiently collect the rainwater collected by each funnel-shaped accommodation cavity 102, and maintain the cleanliness and dryness of the roof surface. The configuration of the drainage strips 130 further enhances the efficiency of the drainage system. Each laying component 110 corresponds to a drainage strip 130, the drainage strip 130 extends along the radial direction of the laying unit 100, and defines a drainage groove running through two ends thereof, thereby ensuring that rainwater can flow smoothly to the storm sewer 120 in all directions. Through the direct connection between the drainage strip 130 and the end of the laying component 110, rainwater can be quickly drained from the curtain wall surface, which effectively prevents water accumulation and infiltration problems, and reducing structural corrosion or damage that may be caused by water retention.

In the embodiment, the multiple drainage strips 130 are arranged at uniform intervals, and are disposed surrounding the storm sewer 120.

The disclosure further provides a construction method of a roof curtain wall structure, including the following steps. Multiple positioning positions are arranged on a building base. An overall structural keel is installed according to the multiple positioning positions. The multiple laying units 100 are installed on the overall structural keel. Specifically, the positioning point 101 of each of the multiple laying units 100 corresponds to one of the multiple positioning positions.

In practice, the multiple positioning positions are arranged on the building base. A construction team first uses measuring tools to accurately determine and mark installation position points (i.e., the positioning positions) of flower umbrella units on the building base according to design drawings. The positioning points 101 will serve as a basis for subsequent installation work.

The overall structural keel is installed according to the positioning positions. After the positioning points 101 marking is completed, the construction personnel will install the overall structural keel according to the positioning points 101. The keel is usually made of metal or other solid materials, which is a key part for supporting the roof curtain wall structure and needs to ensure accurate correspondence with the positioning points 101.

The multiple laying units 100 are installed on the overall structural keel. The laying units 100, that is, the flower umbrella units, are basic units that constitutes the roof curtain wall structure. These units are prefabricated in a specific shape and size in the factory and then transported to the construction site. Specifically, a positioning point 101 of a laying unit 100 corresponding to one of the positioning positions, that is, each laying unit 100 has one or more positioning points 101, which need to accurately correspond to the positioning points pre-marked on the building base, so as to ensure that each unit is installed on a correct position and maintains the consistency and stability of the overall structure.

The positions of the laying units 100 are checked and adjusted. After the laying units 100 are installed on the keel, the construction personnel need to carefully check and make necessary adjustments to the position of each unit to ensure that they fully meet design requirements and construction standards.

The laying units 100 are fixed. Once the positions are confirmed to be correct, the construction personnel will use appropriate fasteners and connectors to fix the laying units 100 to the keel to ensure that they remain stable in all weather conditions.

The connection of a drainage system is completed. After the laying units 100 are installed and fixed, the construction team needs to ensure that the drainage system is correctly connected to ensure that rainwater can be effectively drained from the roof to avoid water accumulation and leakage.

A comprehensive inspection and quality control are performed. Finally, the construction team will perform the comprehensive inspection of the entire roof curtain wall structure to ensure that all installation work meets the design specifications and safety standards. This may include inspections of structural stability, waterproof performance, and aesthetic appearance.

In the description of the specification, the description with reference to terms "an embodiment", "some embodiments", "mode", "specific mode", or "some modes" means that the specific features, structures, materials or characteristics described in conjunction with the embodiments or modes are included in at least one embodiment or mode of the embodiments of the disclosure. In the specification, schematic representations of the above terms do not necessarily refer to the same embodiment or mode. Moreover, the described specific features, structures, materials or characteristics may be combined in any one or more embodiments or modes in a suitable manner. In addition, those skilled in the art may combine the different embodiments or modes described in the specification and the features of the different embodiments or modes, without contradiction.

Finally, it should be noted that the above embodiments are only used to illustrate the technical solutions of the disclosure, rather than to limit the disclosure. Although the disclosure has been described in detail with reference to the embodiments, those skilled in the art should understand that they can still modify the technical solutions described in the aforementioned embodiments, or make equivalent replacements for some of the technical features therein. However, these modifications or replacements do not deviate the essence of the corresponding technical solutions from a spirit and a scope of the technical solutions of the embodiments of the disclosure.

What is claimed is:

1. A roof curtain wall structure, comprising:

a plurality of laying units (100), arranged in a matrix array, wherein each of the plurality of laying units (100) comprises a plurality of laying components (110), and the plurality of laying components (110) are sequentially connected along a circumferential direction of the laying unit (100) to form a positioning point (101) on a center of the laying unit (100);

wherein along a first direction (F), any adjacent two of the plurality of laying units (100) are connected through two of the plurality of laying components (110) to define three of hollow areas (131) collinear along the first direction (F) on an area where the adjacent two of the plurality of laying units (100) are located;

wherein the positioning point (101) is located on a center of each of the hollow areas (131); and wherein the first direction (F) is a length direction or a width direction of the matrix array;

wherein each of the plurality of laying units (100) further comprises a storm sewer (120) and a plurality of drainage strips (130);

the storm sewer (120) is located on the center of each of the hollow areas (131);

in the laying unit (100), each of the plurality of drainage strips (130) corresponds to one of the plurality of laying components (110), the plurality of drainage strips (130) are disposed along a radial direction of the laying unit (100), and each of the plurality of drainage strips (130) defines a drainage groove running through two ends thereof; and the storm sewer (120) is connected to an end of each the plurality of laying components (110) through the plurality of drainage strips (130).

2. The roof curtain wall structure as claimed in claim 1, wherein along a second direction(S), two sides of a connection of centers of the hollow areas (131) of any adjacent two of the plurality of laying units (100) have two hollow areas (131) collinear along the first direction (F); and the second direction(S) is a length direction or a width direction of the matrix array, and the second direction (S) is different from the first direction.

3. The roof curtain wall structure as claimed in claim 2, wherein the plurality of laying units (100) are sequentially arranged, and the plurality of laying units (100) are a first laying unit (1001), a second laying unit (1002), a third laying unit (1003) and a fourth laying unit (1004); and along the first direction (F), the first laying unit (1001) is connected to the second laying unit (1002) through a first laying component (111) and a second laying component (112) to define a hollow area (131) at a connection between the first laying unit (1001) and the second laying unit (1002), and the third laying unit (1003) is connected to the fourth laying unit (1004) through a third laying component (113) and a fourth laying component (114) to define a hollow area (131) at a connection between the third laying unit (1003) and the fourth laying unit (1004).

4. The roof curtain wall structure as claimed in claim 3, wherein along the second direction(S), the first laying unit (1001) is connected to the fourth laying unit (1004), the second laying unit (1002) is connected to the third laying unit (1003), and the second laying component (112) is connected to the third laying component (113).

5. The roof curtain wall structure as claimed in claim 4, wherein along the first direction (F), the first laying component (111) is disposed opposite to the second laying component (112), and the third laying component (113) is disposed opposite to the fourth laying component (114).

6. The roof curtain wall structure as claimed in claim 5, wherein each of the plurality of laying units (100) is enclosed by the plurality of laying components (110) to define an accommodation cavity (102), and the accommodation cavity (102) is funnel-shaped with an inner diameter gradually decreasing from top to bottom for collecting and discharging rainwater.

* * * * *